US007322501B2

(12) United States Patent
Ishizawa et al.

(10) Patent No.: US 7,322,501 B2
(45) Date of Patent: Jan. 29, 2008

(54) FASTENER DRIVING TOOL

(75) Inventors: Yoshinori Ishizawa, Ibaraki (JP); Hiroki Kitagawa, Ibaraki (JP); Masashi Nishida, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/176,293

(22) Filed: Jul. 8, 2005

(65) Prior Publication Data

US 2006/0016845 A1 Jan. 26, 2006

(30) Foreign Application Priority Data

Jul. 9, 2004 (JP) ..... P2004-203680

(51) Int. Cl.
*B25C 1/04* (2006.01)

(52) U.S. Cl. ..... 227/8; 227/10; 227/130; 277/188

(58) Field of Classification Search ..... 227/130, 227/8–10; 277/188, 434
See application file for complete search history.

(56) References Cited

U.S. PATENT DOCUMENTS 3,023,014 A * 2/1962 Donner ..... 277/582
3,375,758 A * 4/1968 Novak et al. ..... 91/356
3,527,142 A * 9/1970 Obergfell ..... 91/461
3,673,922 A * 7/1972 Doyle ..... 91/422
3,815,475 A * 6/1974 Howard et al. ..... 91/399
3,945,551 A * 3/1976 Sato et al. ..... 227/136
4,483,473 A * 11/1984 Wagdy ..... 227/8
4,509,669 A * 4/1985 Elliesen ..... 227/130
5,711,471 A * 1/1998 White ..... 227/113
5,775,201 A * 7/1998 Tanji et al. ..... 92/85 R
6,116,489 A * 9/2000 Branston ..... 227/10
2005/0279802 A1* 12/2005 Moeller ..... 227/130

FOREIGN PATENT DOCUMENTS

JP 2002-321168 11/2002
JP 2003-236768 8/2003

* cited by examiner

*Primary Examiner*—Rinaldi I. Rada
*Assistant Examiner*—Michelle Lopez
(74) *Attorney, Agent, or Firm*—Mattingly, Stanger, Malur & Brundidge, P.C.

(57) ABSTRACT

A cylinder is constituted such that the cylinder includes a large diameter portion constituted by forming a portion thereof brought into contact with an O ring by a diameter larger than a diameter of other portion when a piston is disposed at an upper dead center and a small diameter portion formed downward from the large diameter portion, and a fastening margin is provided between an outer periphery of the O ring and an inner periphery of the cylinder even when the piston is disposed at any position from the upper dead center to a lower dead center and a clearance is provided between an inner periphery of the O ring and an outer periphery of a groove.

15 Claims, 11 Drawing Sheets

FASTENER DRIVING TOOL

BACKGROUND OF THE INVENTION

1. Field of the Invention

The present invention relates to a fastener driving tool for striking a nail to insert the nail into a material such as wood using a power source of compressed air. More particularly, the present invention relates to a fastener driving tool for striking a nail including technology of holding a piston at an upper dead center and cooling a bumper.

2. Description of the Related Art

A bumper generates heat by absorbing extra energy of a piston in striking. In recent years, it is requested to promote durability of a bumper in accordance with high output formation of a fastener driving tool.

There is a description in JP-A-2003-236768 as follows. By installing an exhaust path for exhausting compressed air to the atmosphere after striking a fastener to be brought into contact with an outer peripheral portion of a cylinder, compressed air a temperature of which is dropped by being adiabatically expanded in the exhaust path cools the cylinder.

According to JP-A-2002-321168, by providing a hole for communicating a return air chamber and inside of a cylinder by constituting an angle in a horizontal direction relative to a radius direction of the cylinder, a swirl flow is produced at an outer periphery of a bumper to cool the bumper.

Further, there is a fastener driving tool as shown by FIG. 10 and FIG. 11. The fastener driving tool as illustrated in FIGS. 10 and 11 includes in a portion thereof a piston 5, an O ring 7 and a cylinder 6. Further, technical terms and notations of respective portions are commonly used.

An outer diameter of the O ring 7 is designed to be slightly larger than an inner diameter of a small diameter portion 6*a* of the cylinder 6 and to produce a clearance between an inner diameter of the O ring 7 and an outer diameter of a groove 5*a* of the piston 5. As shown by FIG. 10, by making compressed air from a returning chamber flow, the O ring 7 is pressed in an outer diameter direction as shown by arrow marks to seal at point A and point C. A total of the O ring 7 is exerted with a force as shown by an arrow mark D directed from a center O of the O ring 7 to a middle point of point A and point C.

The cylinder 6 is formed with a large diameter portion 6*c* at an upper end thereof, and an inclined face 6*b* is extended from the large diameter portion 6*c* in a lower direction to connect to the small diameter portion 6*a*. A clearance between the large diameter portion 6*c* and the O ring 7 is about 2.4 mm in a diameter direction. When the piston 5 is disposed at a position shown in FIG. 10, the piston 5 and the small diameter portion 6*a* are brought into contact with each other to form the seal. When the piston 5 is disposed at a position shown in FIG. 11, a clearance is produced between the piston 5 and the large diameter portion 6*c*.

Therefore, when the piston 5 is returned to a side of the upper dead center by compressed air from a lower side of the piston 5 after striking operation, in the case in which the piston 5 is disposed at the position shown in FIG. 10, compressed air is not leaked from between the piston 5 and the cylinder 6 and all of compressed air is exhausted from a clearance by way of a bumper provided at the lower dead center of the piston 5. When the piston 5 returns to a position shown in FIG. 11, that is, a vicinity of the upper dead center, compressed air is exhausted also from a clearance between the piston 5 and the cylinder 6 and therefore, a flow of air impinging on the bumper is reduced.

The constitution described in JP-A-2003-236768 and JP-A-2002-321168 is difficult to fabricate and difficult to realize. Further, according to the fastener driving tool shown in FIG. 10 and FIG. 11, cooling of the bumper is insufficient.

SUMMARY OF THE INVENTION

It is an object of the invention to provide a fastener driving tool having high durability of a bumper by resolving the above-described drawback of the background arts.

In a fastener driving tool including an outer frame portion, a cylinder contained in the outer frame portion, a piston which is capable of being reciprocated in an up and down direction in the cylinder and including a groove in a ring-like shape at an outer periphery thereof, an O ring provided at the groove slidably on an inner periphery of the cylinder, a driver blade extended downward from the piston, a bumper brought into contact with the piston when the piston is disposed at a lower dead center, a returning chamber provided at an outer periphery of the cylinder, a first air path for communicating a space downward from the piston in the cylinder and the returning chamber, an injecting portion which is extended downward from the outer frame portion for guiding the driver blade, and a second air path formed by a clearance between the driver blade and the injecting portion, the fastener driving tool being constituted such that the cylinder includes a large diameter portion constituted by forming a portion thereof brought into contact with the O ring by a diameter larger than a diameter of other portion when the piston is disposed at an upper dead center, and a small diameter portion formed downward from the large diameter portion, a fastening margin is provided between an outer periphery of the O ring and the inner periphery of the cylinder even when the piston is disposed at any position from the upper dead center to the lower dead center, and a clearance is provided between an inner periphery of the O ring and an outer periphery of the groove.

When constituted in this way, in the case in which the piston returns to the upper dead center, the interval between the piston and the cylinder is firmly sealed and all of compressed air in the returning chamber is exhausted from the second path by passing a surrounding of the bumper. Therefore, the bumper is excellently cooled and the durability is promoted. Further, even when the piston is disposed at any position, compressed air is brought into the clearance to press to widen the O ring. Therefore, a force of bringing the O ring into contact with the inner periphery of the cylinder is maintained to be small and friction loss between the O ring and the cylinder can be reduced.

Further, the fastener driving tool may be constituted such that the outer diameter of the O ring is constituted such that a clearance between the O ring and the large diameter portion is larger than 0 mm and equal to or smaller than 1.2 mm in a diameter direction, and an inner diameter of the small diameter portion is smaller than an outer diameter of the O ring, and a clearance is provided between an inner periphery of the O ring and an outer periphery of the groove even when the piston is disposed at any position from the upper dead center to the lower dead center. Further, the clearance is calculated as a difference between an inner diameter of the large diameter portion 6*c* and the outer diameter of the O ring 7.

When constituted in this way, in the case in which the piston returns to the upper dead center, although a clearance is produced between the piston and the cylinder when pressure of compressed air from the returning chamber is small, during a time period in which the pressure of compressed air from the returning chamber is large, an interval between the piston and the cylinder is sealed, and all of compressed air in the returning chamber is exhausted from the second path by passing the surrounding of the bumper. Therefore, the bumper is excellently cooled and durability is promoted. Further, even when the piston is disposed at any position, compressed air is brought into the clearance to press to widen the O ring. Therefore, a force of bringing the O ring into contact with the inner periphery of the cylinder is maintained to be small and friction loss between the O ring and the cylinder can be reduced.

According to the invention described in claim 1 and claim 2, the fastener driving tool having the high durability of the bumper can be provided.

DETAILED DESCRIPTION OF THE PREFERRED EMBODIMENTS

A constitution of a fastener driving tool 1 will be explained in reference to FIG. 1 through FIG. 9.

Figure 1:
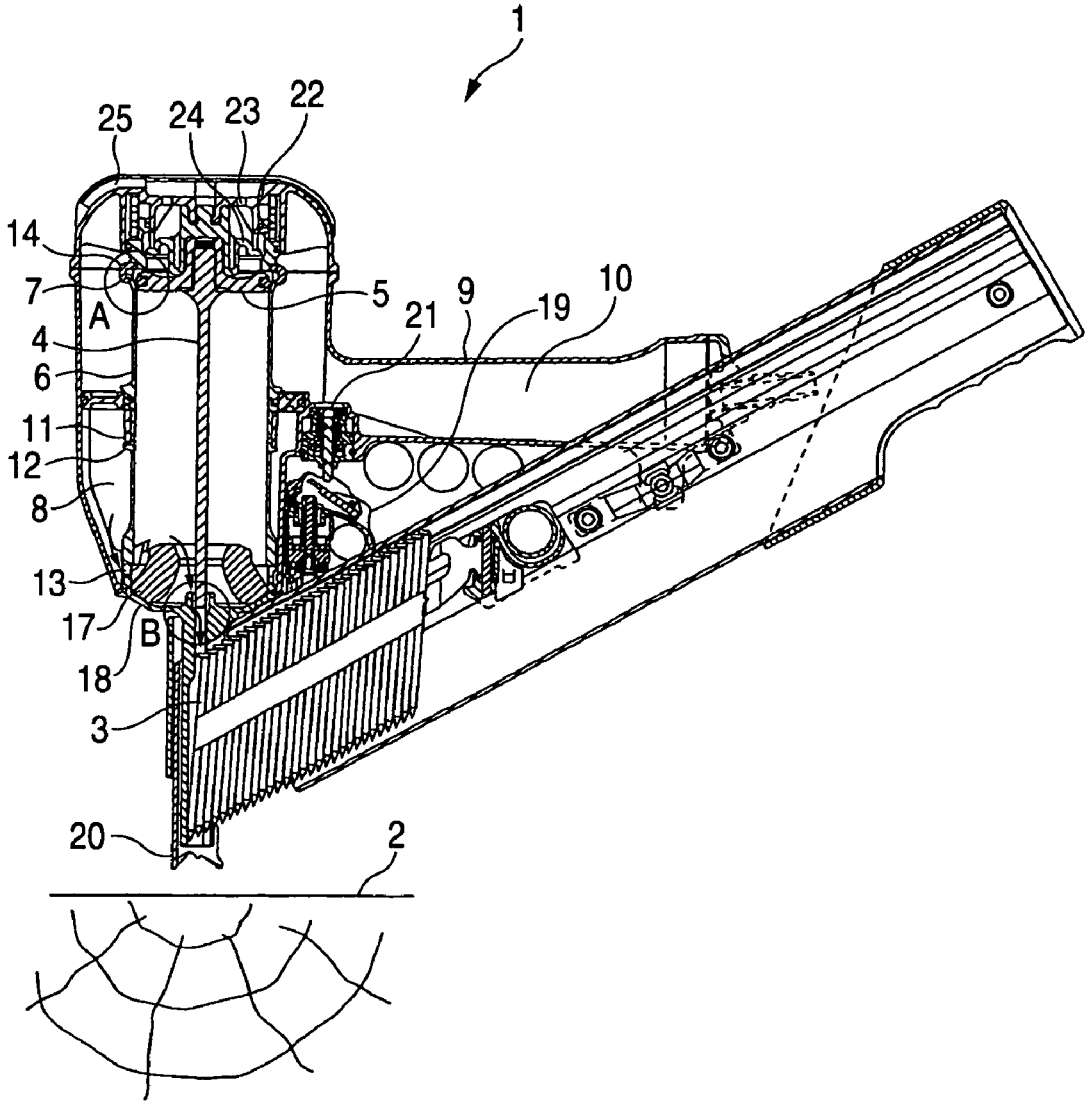
FIG. 1 is a total structure view of a fastener driving tool according to an embodiment of the invention.

As shown by FIG. 1, there are provided a driver blade 4 for striking a nail 3 to a struck member of a material such as wood 2, and a piston 5 sliding upward and downward by receiving a pressure of compressed air, and the piston 5 is integrally connected with the driver blade 4. An outer periphery of the piston 5 is crowned with the O ring 7 made of rubber for sealing the cylinder 6 and the piston 5.

Figure 2:
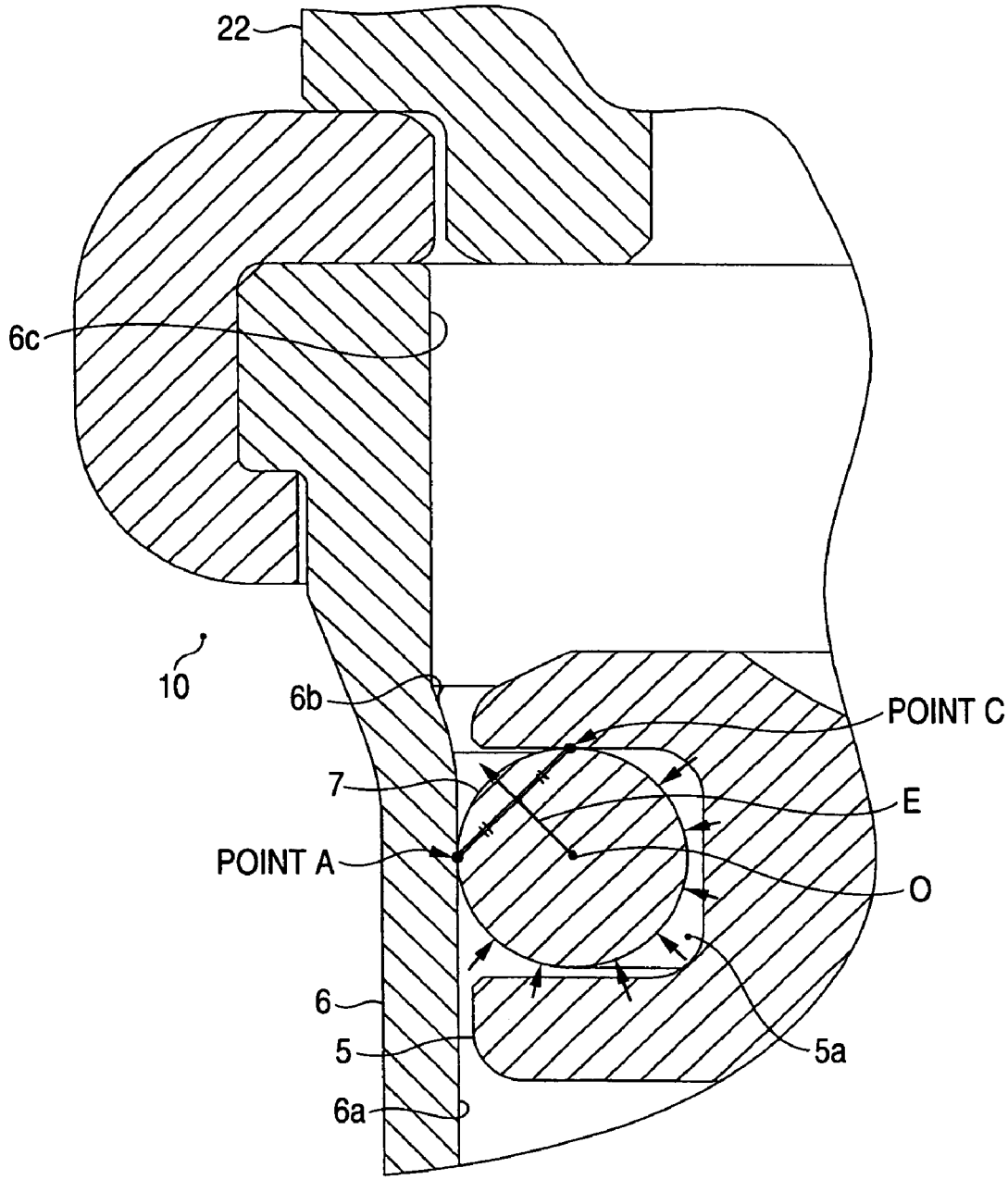
FIG. 2 is a view enlarging a portion A showing a state of sliding an O ring on a small diameter portion of a cylinder in the fastener driving tool according to the embodiment of the invention.

An outer diameter of the O ring 7 is set to be slightly larger than an inner diameter of the small diameter portion 6*a* (that is, to provide a fastening margin). Further, as shown by FIG. 2, an inner diameter of the O ring 7 and an outer diameter of the groove 5*a* of the piston 5 are designed to produce a clearance therebetween. A pressure is applied on the O ring 7 as shown by arrow marks by making compressed air from the returning chamber 8 flow to the clearance. Thereby, a force is exerted in a direction of an arrow mark E directing from the center O of the O ring 7 to a middle point of point A and point C to seal at point A and point C.

Substantially at a center of a body 9 constituting an outer frame portion, there is provided a pressure air accumulating chamber 10 for storing compressed air from a compressor or the like, not illustrated, and at an outer periphery of a lower side of the cylinder 6, there is provided the returning chamber 8 for storing compressed air for returning the piston 5 from a lower dead center to an upper dead center. The cylinder 6 is provided with an air path 12 having a check valve 11 comprising a flexible material of rubber or the like such that compressed air flowing to the cylinder 6 from the pressure accumulating chamber 10 flows only in a direction of the returning chamber 8, and an air path 13 constituting a first air path for returning the piston 5 to the upper dead center by communicating a lower side of the piston 5 in the cylinder 6 and the returning chamber 8.

An upper end of the cylinder 6 is provided with the large diameter portion 6*c* having a large inner diameter. The inner diameter of the large diameter portion 6*c* is set to be smaller than the outer diameter of the O ring 7. That is, there is a fastening margin between the large diameter portion 6*c* and the O ring 7. The small diameter portion 6*a* is provided on a lower side of the large diameter portion 6*c*, and the large diameter portion 6*c* and the small diameter portion 6*a* are connected by the gradual inclined face 6*b*.

Further, striking energy of the fastener driving tool 1 is provided with an allowance to be able to strike the nail 3 flush with a face of the wood 2 even when a hardness of the wood 2 is changed. The lower dead center of the piston 5 is provided with a bumper 17 comprising an elastic member of rubber or the like for absorbing extra energy after striking the nail 3 by the driver blade 4. The bumper 17 converts kinetic energy of the piston 5 into thermal energy, sound, deformation of the piston and the like by being deformed. Heat is discharged to the atmosphere from a surface of the body 9 by way of nose 18 and the body 9 while being cooled by compressed air passing through the air path 13 disposed at an outer periphery of the bumper 17.

Figure 4:
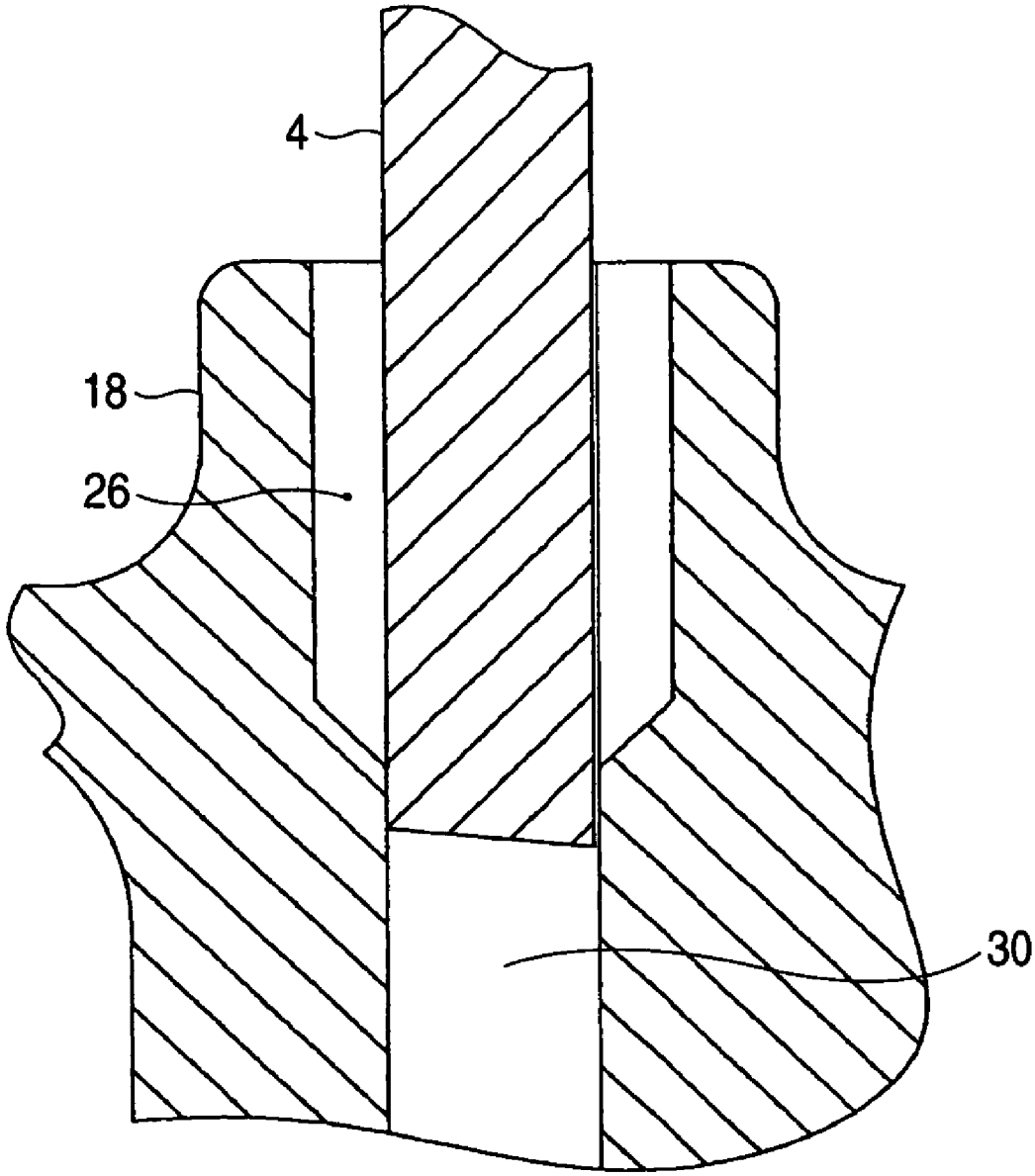
FIG. 4 is a view enlarging a portion B showing a position of a driver blade before returning a piston to an upper dead center in the fastener driving tool according to the embodiment of the invention.

The nose 18 constituting an injecting portion guides the driver blade 4, the nail 3. As shown by FIG. 4, a small clearance (clearance between an injecting port 30 and the driver bit 4) and a large clearance 26 there above are provided between the nose 18 and the driver blade 4. When the piston 5 is disposed at a vicinity of the upper dead center, a front end of the driver blade 4 is set to be disposed upward from a lower end of the clearance 26. A second air path is formed by the small clearance and the large clearance 26 between the driver blade 4 and the nose 18.

Striking operation by the fastener driving tool 1 having the above-described constitution will be explained in reference to FIG. 1 through FIG. 9.

FIG. 1 shows a state of storing compressed air by connecting a compressor and an air hose to a main body of the fastener driving tool 1. Compressed air is accumulated in the pressure accumulating chamber 10.

When a trigger valve 21 is made ON by executing both of operation of pulling a trigger 19 and operation of pressing a push lever 20 to the wood 2, a main valve 22 is moved to an upper side, and the pressure accumulating chamber 10 and an upper side of the piston 5 in the cylinder 6 are communicated with each other. Further, the pressure accumulating chamber 10 and an air path 23 are blocked from each other.

The driver blade 4 strikes the nail 3 while moving to the side of the lower dead center abruptly by compressed air flowing from the pressure accumulating chamber 10 to the upper side of the piston 5 in the cylinder 6. Air on a lower side of the piston 5 in the cylinder 6 flows into the returning chamber 8 by way of the air path 13, and when the piston 5 passes through the air path 12, a portion of compressed air on the upper side of the piston 5 flows into the returning chamber 8 by way of the air path 12. The piston 5 is brought into contact and deformed by the bumper 17 and extra energy is absorbed thereby.

When the trigger valve 21 is made OFF by returning the trigger 19 or stopping the operation of the push lever 20 for pressing the wood 2, the main valve 22 is moved to a lower side.

Thus, when main valve 22 is closed, the pressure accumulating chamber 10 and the upper side of the piston 5 in the cylinder 6 are blocked from each other, the upper side of the piston 5 in the cylinder 6 and the atmosphere are communicated with each other by disengagement of the main valve 22 and an exhaust rubber 24, and compressed air on the upper side of the piston 5 is exhausted from an exhaust hole 25 to the atmosphere by way of the air path 23. A pressure difference is produced between the upper face and the lower face of the piston 5, the lower side of the piston 5 is pressed by compressed air accumulated in the returning chamber 8, and the piston 5 is abruptly moved to the side of the upper dead center.

A state immediately before returning the piston 5 to the upper dead center will be explained in reference to FIG. 2.

Compressed air from the returning chamber 8 flows into the groove 5*a* of the piston 5, presses the O ring 7 in the direction of the arrow mark E as shown by the arrow marks, the O ring 7 and the cylinder 6 are sealed at point A, and the O ring 7 and the piston 5 are sealed at point C. The clearance 26 between the driver blade 4 and the nose 18 are brought into state of FIG. 4 and is not opened yet.

The state of passing the O ring 7 on the inclined face 6*b* will be explained in reference to FIG. 3 and FIG. 4.

Figure 3:
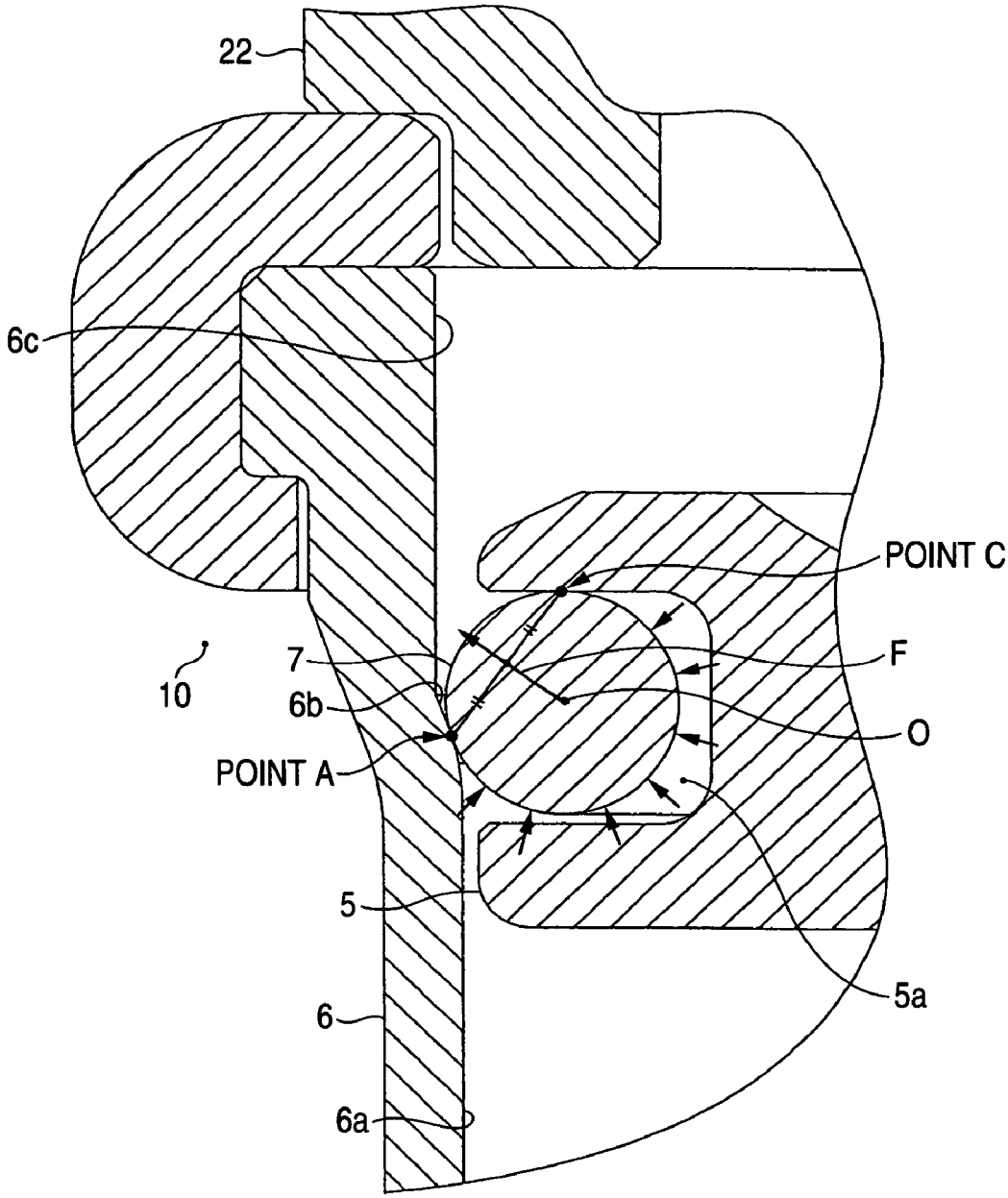
FIG. 3 is a view enlarging the portion A showing a state of sliding the O ring on an inclined face of the cylinder in the fastener driving tool according to the embodiment of the invention.

As shown by FIG. 3, compressed air from the returning chamber 8 flows into the groove 5*a* of the piston 5, presses the O ring 7 in an arrow mark F direction, the O ring 7 and the cylinder 6 are sealed at point A and the O ring 7 and the piston 5 are sealed at point C. Further, as shown by FIG. 4, the piston 5 is not returned to the upper dead center yet and therefore, the clearance 26 between the driver blade 4 and the nose 18 is not opened yet.

Figure 5:
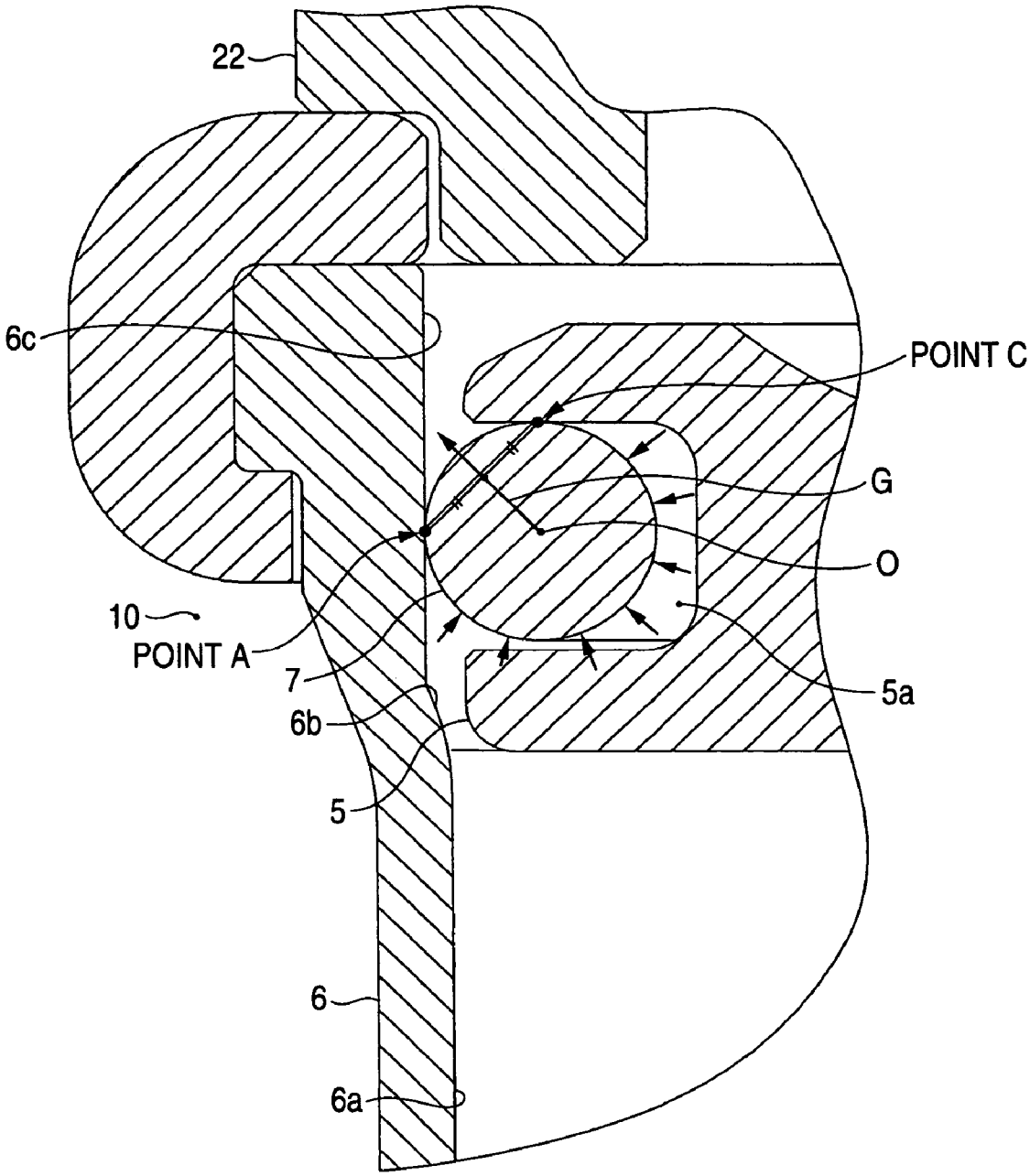
FIG. 5 is a view enlarging the portion A showing a state of sliding the O ring on a large diameter portion of the cylinder in the fastener driving tool according to the embodiment of the invention.

A state in which the O ring 7 returns to the upper dead center and the pressure of compressed air from the returning chamber 8 is higher than the atmospheric pressure will be explained in reference to FIG. 5.

Figure 6:
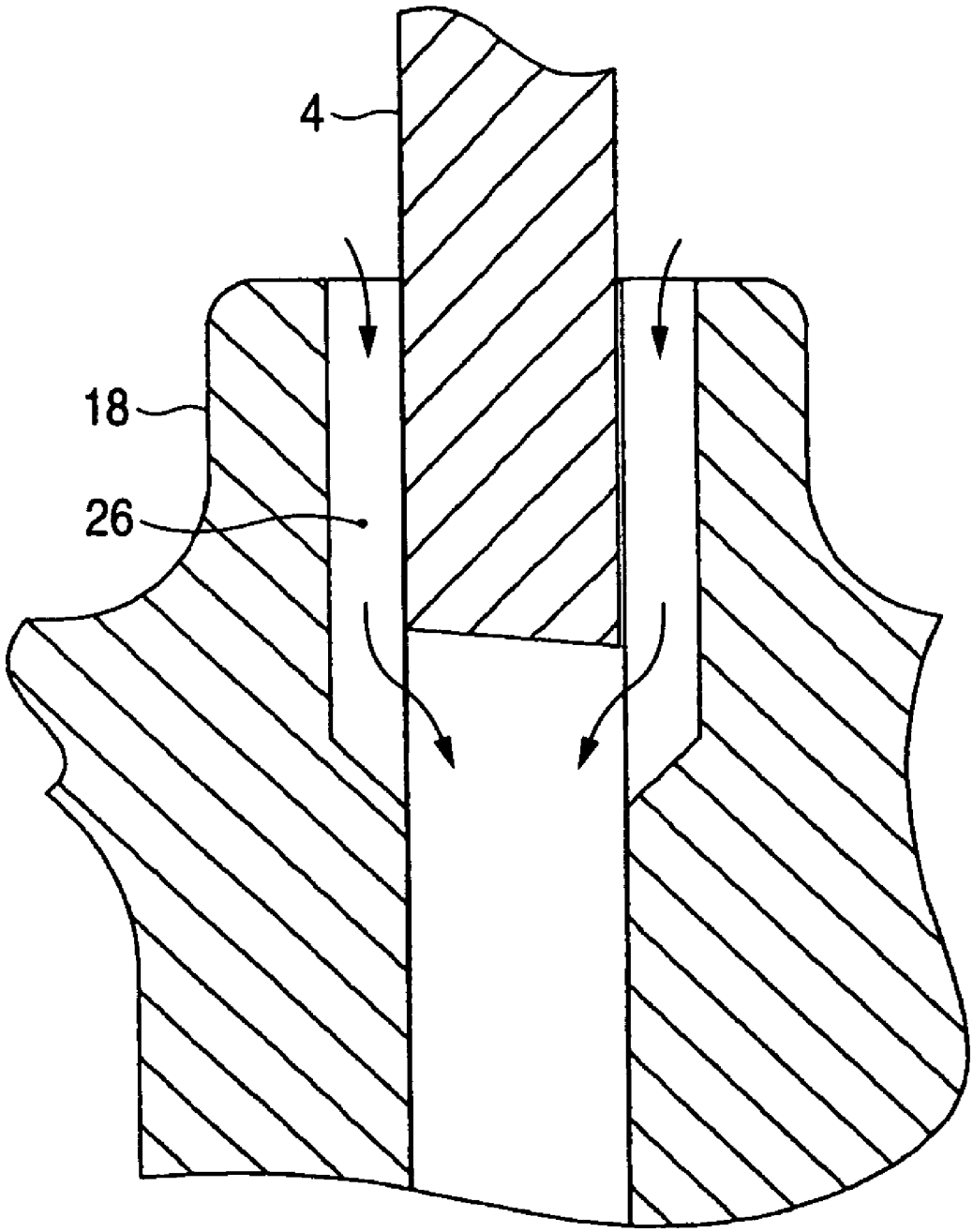
FIG. 6 is a view enlarging the portion B showing a position of the driver blade when the piston returns to the upper dead center in the fastener driving tool according to the embodiment of the invention.
Figure 11:
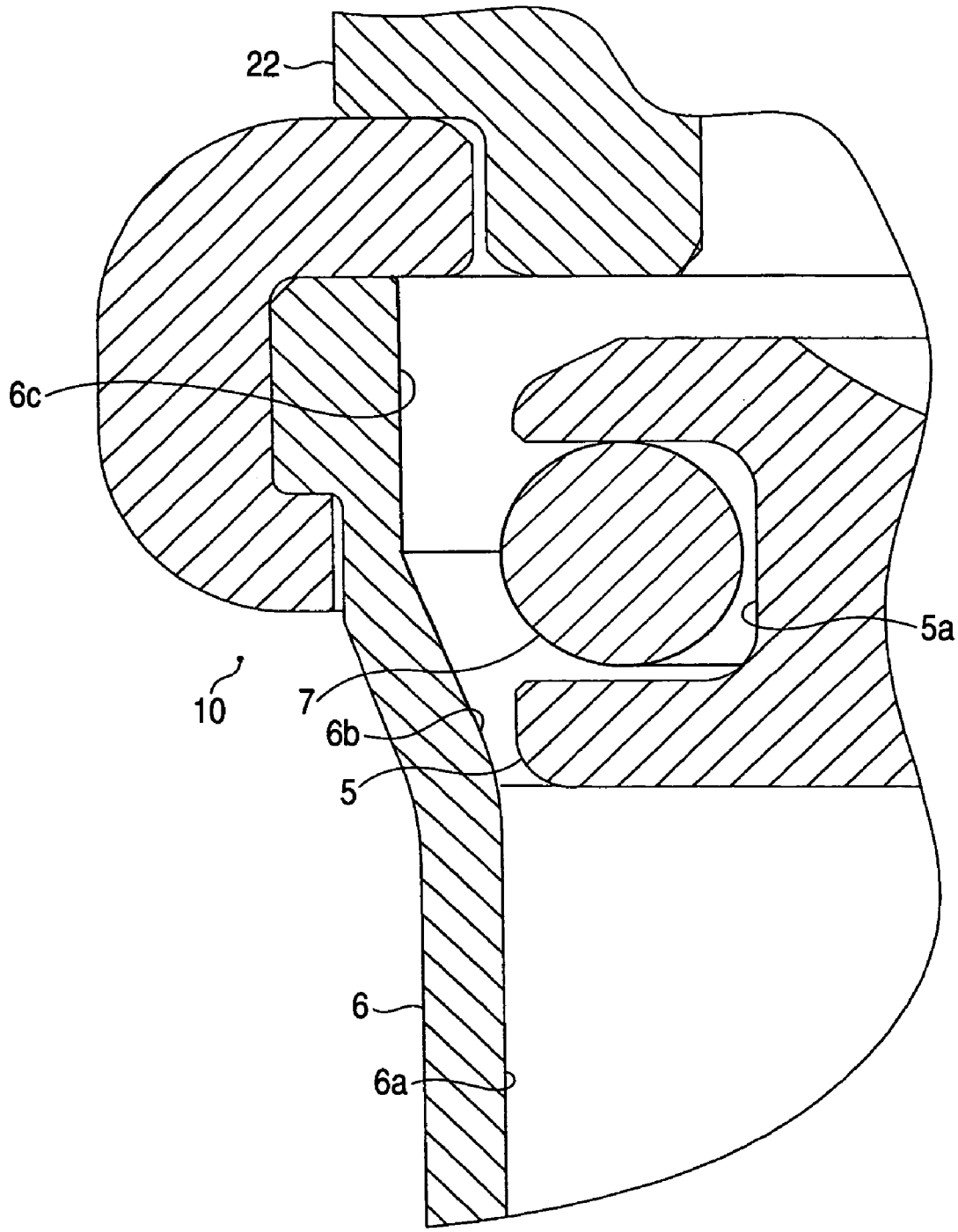
FIG. 11 is a view enlarging an essential portion showing a state of returning the O ring to an upper dead center in the fastener driving tool of the background art.

Similar to FIG. 2, compressed air from the returning chamber 8 flows into the groove 5*a* of the piston 5, presses the O ring 7 in an arrow mark G direction, the O ring 7 and the cylinder 6 are sealed at point A, and the O ring 7 and the piston 5 are sealed at point C. Different from the fastener driving tool shown in FIG. 11 and FIG. 12 of the background art, a fastening margin is provided between the large diameter portion 6*c* and the O ring 7. Thereby, a clearance is not produced between the large diameter portion 6*c* and the outer diameter of the O ring 7 and extra compressed air of the returning chamber 8 is not exhausted. Further, as shown by FIG. 6, the clearance 26 between the driver blade 4 and the nose 18 is opened and all of extra compressed air of the returning camber 8 is exhausted from the clearance 26 by way of the outer periphery and the inner side of the bumper 17 via the air path 13. Therefore, all of compressed air is used for cooling the bumper 17.

Figure 7:
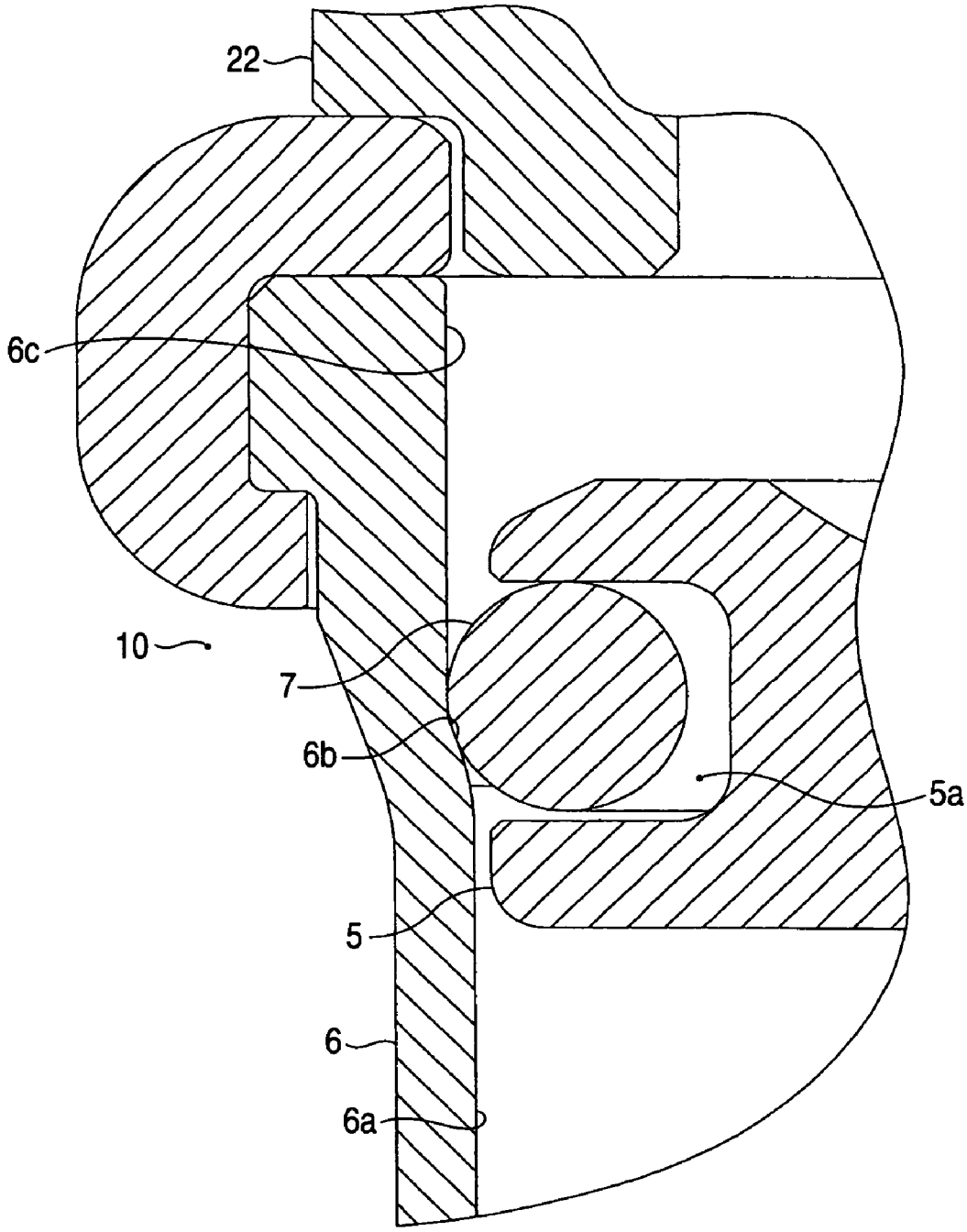
FIG. 7 is a view enlarging the portion A showing a state of engaging the O ring with the inclined face of the cylinder in the fastener driving tool according to the embodiment of the invention.

The state in which the O ring 7 returns to the upper dead center, extra compressed air in the returning chamber 8 is exhausted to produce about the atmospheric pressure will be explained in reference to FIG. 7.

There is not the force of pressing the O ring 7 to the outer peripheral side by compressed air. However, since the outer diameter of the O ring 7 is larger than the inner diameter of the small diameter portion 6*a*, the O ring 7 is hung at the inclined face 6*b*. Therefore, the piston 5 is not dropped in the direction of the lower dead center by its own weight.

The above description is of a stroke of striking a single piece of the nail 3 to the wood 2.

A state in which the O ring 7 is worn will be explained in reference to FIG. 9.

Figure 9:
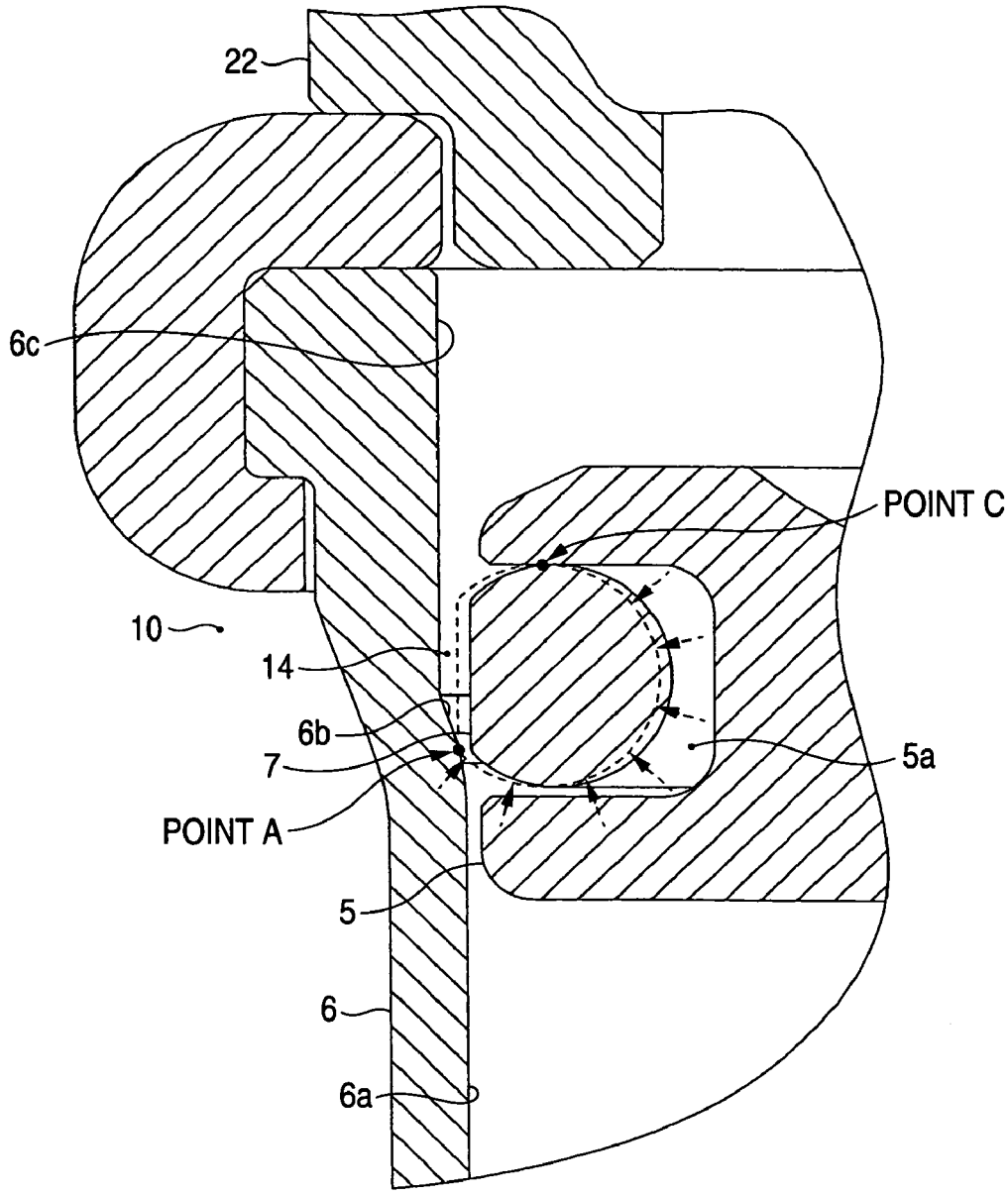
FIG. 9 is a view enlarging the portion A showing a state of wearing the O ring in the fastener driving tool according to the embodiment of the invention.
Figure 10:
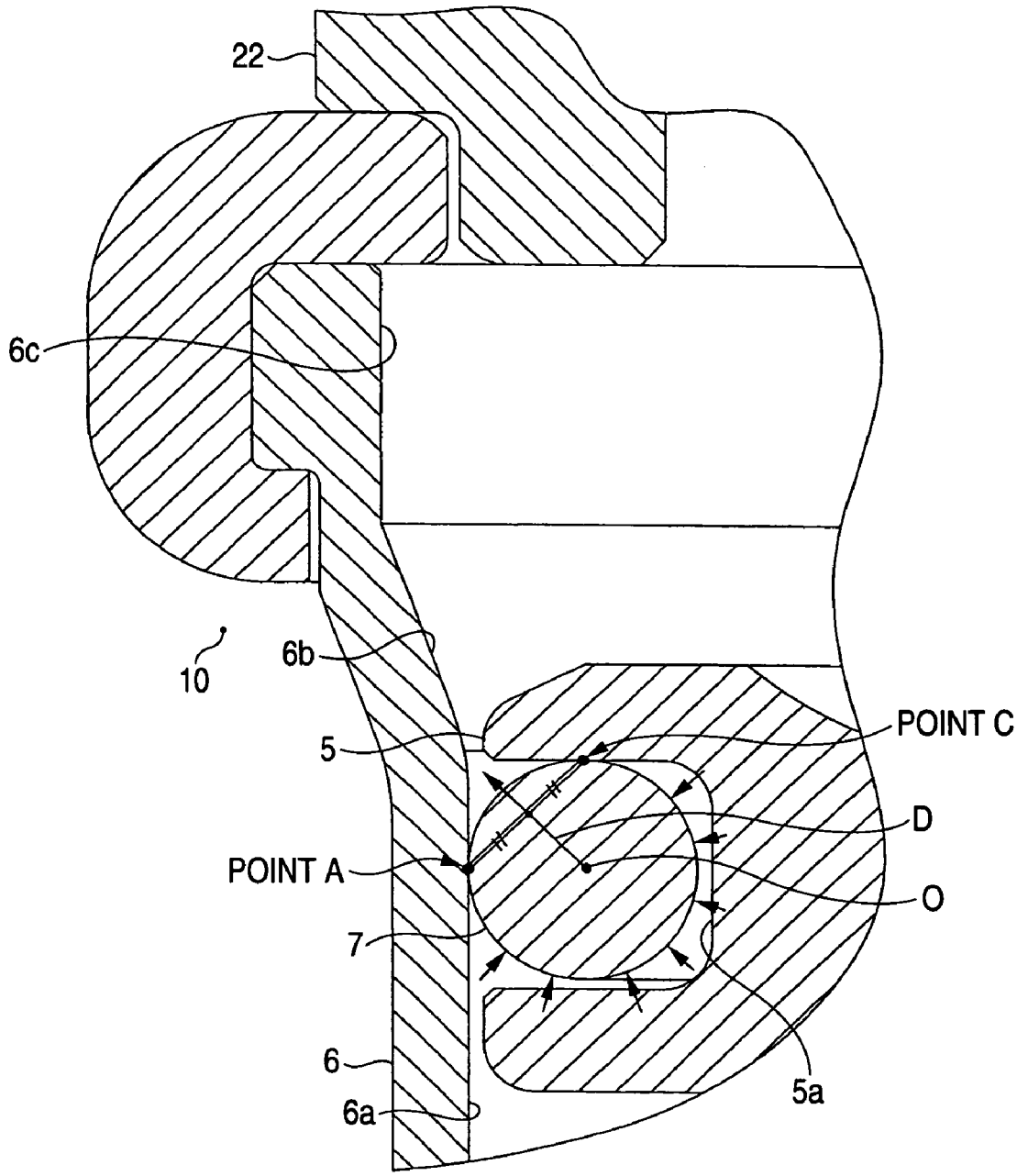
FIG. 10 is a view enlarging an essential portion showing a state of sliding an O ring on a small diameter portion of a cylinder in a fastener driving tool of a background art.

FIG. 9 shows a state of the worn O ring 7 when extra compressed air of the returning chamber 8 is exhausted from the clearance 26 to produce the atmospheric pressure. There is no force of pressing the O ring 7 to the outer peripheral side by compressed air and the O ring 7 is contracted from a shape of a broken line to a shape of a bold line. When the outer diameter of the O ring 7 is worn to a degree shown in FIG. 9, the outer diameter of the O ring 7 becomes smaller than the inner diameter of the small diameter portion 6*a*, the piston 5 is not held at the upper dead center further and is moved in the direction of the lower dead center by its own weight. Thereby, an operator knows that the O ring 7 is worn more than a usable limit. Further, in such a degree of worn amount, the piston 5 can be guided to a degree of not being brought into direct contact with the small diameter portion 6*a* in a state of pressing to widen the O ring 7 by compressed air. At a time point at which the piston 5 is dropped by its own weight, the piston 5 and the small diameter portion 6*a* do not impair each other and therefore, when the o ring 7 is interchanged by a new one at the time point, the fastener driving tool can be recovered to an excellent state before enlarging damage.

A second embodiment will be explained in reference to FIG. 8.

Figure 8:
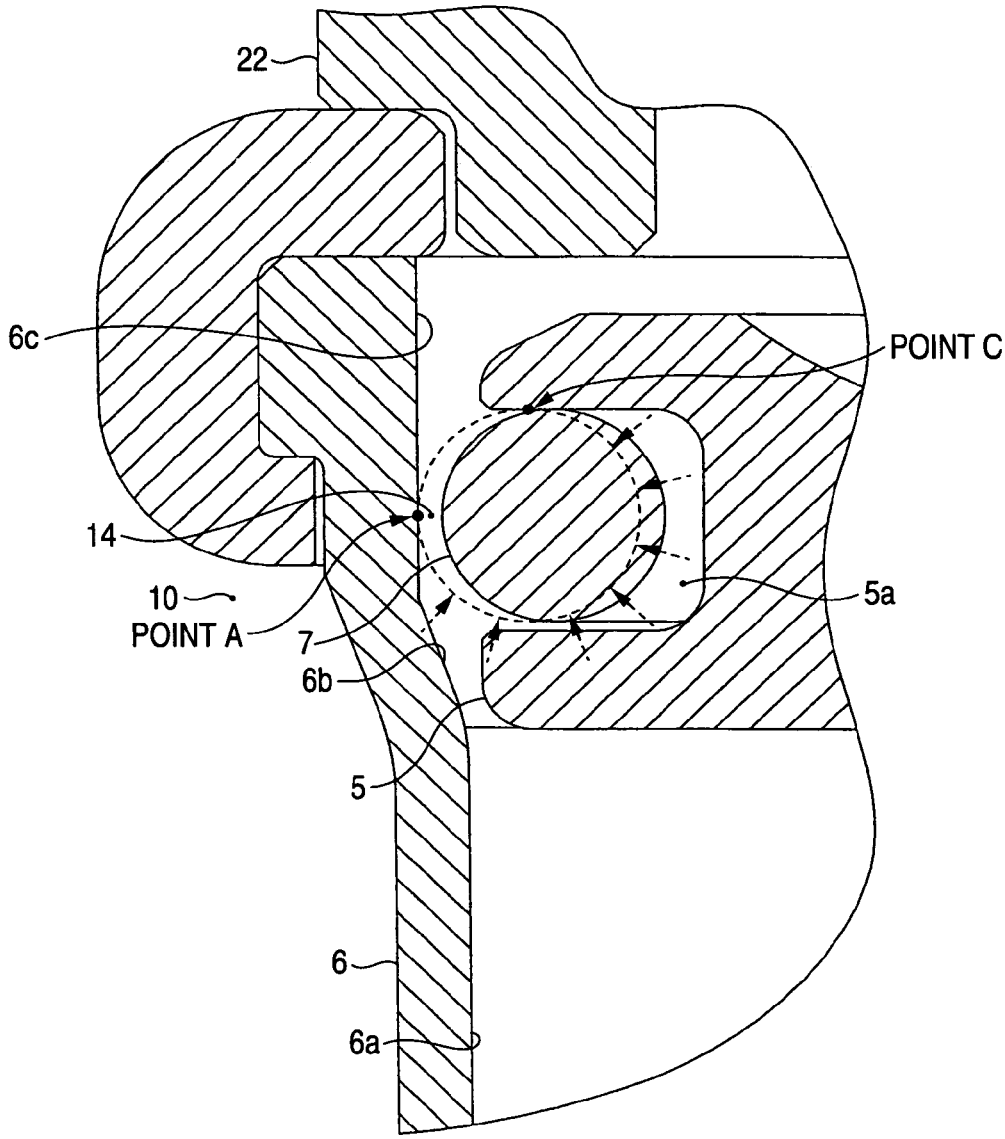
FIG. 8 is a view enlarging the portion A showing a state of producing a clearance between an O ring and a large diameter portion of a cylinder in a fastener driving tool according to a second embodiment of the invention.

FIG. 8 shows a state in which the O ring 7 returns to the upper dead center, and extra compressed air in the returning chamber 8 is exhausted from the clearance 26 to produce the atmospheric pressure. According to the embodiment, the outer diameter of the O ring 7 is constituted such that the clearance between the O ring 7 and the large diameter portion 6*c* in a state in which compressed air is not present is larger than 0 mm in the diameter direction and equal to or smaller than 1.2 mm and the inner diameter of the small diameter portion 6*a* is smaller than the outer diameter of the O ring 7. Whereas the clearance of the background art is about 2.4 mm, the clearance is set be smaller. Further, the clearance is calculated as a difference between the inner diameter of the large diameter portion 6*c* and the outer diameter of the O ring 7. While the pressure of the compressed air is high, the O ring 7 is pressed to widen to form seal as shown by a broken line of FIG. 8. At this occasion, similar to the first embodiment, compressed air is exhausted by way of the clearance 26 and is used for cooling the bumper 17. When the pressure of compressed air is reduced, the O ring 7 is contracted from a shape shown by the broken line of FIG. 8 to a shape shown by a bold line thereof, and the clearance 14 is produced between the large diameter portion 6*c* and the O ring 7. When the state is brought about, compressed air is discharged also from the clearance 14 in addition to the clearance 26. Further, since the outer diameter of the O ring 7 is larger than the inner diameter of the small diameter portion 6*a*, even when the pressure of compressed air is reduced, the O ring 7 is hung at the inclined face 6*b*. Therefore, the piston 5 is not dropped in the direction of the lower dead center by its own weight.

Whereas when the piston 5 is disposed at a vicinity of the upper dead center, an interval between the piston 5 and the cylinder 6 is always sealed according to the first embodiment, the piston 5 and the cylinder 6 is sealed when the pressure of compressed air is high to some degree according to the second embodiment, and when the pressure is reduced while exhausting compressed air, the clearance is produced. Therefore, although operation of cooling the bumper 17 is slightly inferior to that of the first embodiment, operation of cooling the bumper 17 is superior to that in the constitution of always producing the clearance regardless of the magnitude of the pressure when the piston 5 of the background art is disposed at the vicinity of the upper dead center. Further, compressed air the pressure of which is reduced can immediately be exhausted and a successive nail can immediately be struck.

What is claimed is:

1. A fastener driving tool comprising:

an outer frame portion;

a cylinder disposed in the outer frame portion, wherein the cylinder having a larger inner diameter portion and a small inner diameter portion formed downward from the large diameter portion;

a piston which is capable of being reciprocated in an up and down direction in the cylinder between an upper dead center and a lower dead center, and including a groove in a ring-like shape at an outer periphery thereof, the groove having an upper surface, a lower surface and a side surface;

an O-ring provided in the groove to be slidable on an inner periphery of the cylinder;

a driver blade extended downward from the piston;

a bumper brought into contact with the piston when the piston is disposed at the lower dead center;

a returning chamber provided at an outer periphery of the cylinder;

a first air path for permitting a space downward from the piston in the cylinder to communicate with the returning chamber;

a nose having an injecting portion which is extended downward from the outer frame portion for guiding the driver blade;

a second air path formed between the driver blade and the injecting portion when the piston is at the upper dead center so that compressed air in the returning chamber is exhausted through the second air path wherein a fastening margin is provided between an outer periphery of the O-ring and the inner periphery of the cylinder even when the piston is disposed at any position from the upper dead center to the lower dead center positions, and a clearance is provided between an inner periphery of the O-ring and an outer periphery of the groove, wherein even when the piston is disposed at any position between the large diameter portion and the small diameter portion, compressed air from the returning chamber is brought into the clearance to apply a force to the O-ring, thereby bringing the O-ring into contact with the inner periphery of the cylinder and the upper surface of the groove to seal the piston to the inner periphery of the cylinder.

2. A fastener driving tool according to claim 1, wherein an outer diameter of the O-ring is constituted such that a first clearance between the O-ring and the larger diameter portion is larger than 0 mm and equal to or smaller than 1.2 mm, and an inner diameter of the small diameter portion is smaller than the outer diameter of the O-ring, and wherein a second clearance is provided between an inner periphery of the O-ring and an outer periphery of the groove even when the piston is disposed at any position from the upper dead center to the lower dead center.

3. A fastener driving tool according to claim 1, wherein compressed air in the returning chamber is exhausted from the second air path by passing around the bumper, thereby cooling the bumper.

4. A fastener driving tool according to claim 1, wherein the force applied to the O-ring is set not to exceed a predetermined level to keep friction loss between the O-ring and the cylinder below a predetermined level.

5. A fastener driving tool according to claim 1, wherein when an outer diameter of the O-ring is worn beyond a predetermined amount, the piston is not held at the upper dead center and falls toward the lower dead center, thereby indicating that the O-ring is beyond a usable limit.

6. A fastener driving tool comprising:

an outer frame portion;

a cylinder contained in the outer frame portion;

a piston which is capable of being reciprocated in an up and down direction in the cylinder between an upper dead center and a lower dead center, and including a groove in a ring-like shape at an outer periphery thereof;

an O-ring provided in the groove to be slidable on an inner periphery of the cylinder;

a bumper brought into contact with the piston when the piston is disposed at the lower dead center;

a returning chamber provided at an outer periphery of the cylinder;

a first air path for permitting a space downward from the piston in the cylinder to communicate with the returning chamber; and a nose constituting an injecting portion extending down from the outer frame portion for guiding an a driver blade which extends downward from the piston and a second air path formed by a clearance between the driver blade and the injecting portion, wherein the second air path, formed by the clearance, is disposed within said nose, wherein compressed air in the returning chamber is exhausted by the second air path by passing around the bumper and flowing through the clearance between the driver blade and the injecting portion, wherein the cylinder comprises:

a large diameter portion having a portion which is brought into contact with the O-ring, the portion of the large diameter portion has a diameter larger than a diameter of another portion of the large diameter portion when the piston is disposed at the upper dead center, and a small diameter portion formed downward from the large diameter portion, wherein a fastening margin is provided between an outer periphery of the O-ring and the inner periphery of the cylinder even when the piston is disposed at any position from the upper dead center to the lower dead center positions, and a clearance is provided between an inner periphery of the O-ring and an outer periphery of the groove, and wherein even when the piston is disposed at any position between the large diameter portion and the small diameter portion, compressed air from the returning chamber is brought into the clearance to apply a force to the O-ring, thereby bringing the O-ring into contact with the inner periphery of the cylinder to seal the piston to the inner periphery of the cylinder.

7. A fastener driving tool according to claim 6, wherein compressed air in the returning chamber is exhausted from a second air path formed in the outer frame portion by passing around the bumper, thereby cooling the bumper.

8. A fastener driving tool according to claim 6, wherein the force applied to the O-ring is set not to exceed a predetermined level to keep friction loss between the O-ring and the cylinder below a predetermined level.

9. A fastener driving tool according to claim 6, wherein when an outer diameter of the O-ring is worn beyond a predetermined amount, the piston is not held at the upper dead center and falls toward the lower dead center, thereby indicating that the O-ring is beyond a usable limit.

10. A fastener driving tool comprising:

an outer frame portion;

a cylinder contained in the outer frame portion;

a piston which is capable of being reciprocated in an up and down direction in the cylinder between upper dead center and a lower dead center, and including a groove in a ring-like shape at an outer periphery thereof;

an O-ring provided at the groove to be slidable on an inner periphery of the cylinder;

a bumper brought into contact with the piston when the piston is disposed at the lower dead center;

a returning chamber provided at an outer periphery of the cylinder;

a first air path for permitting a space downward from the piston in the cylinder to communicate with the returning chamber; and a nose constituting an injecting portion extending down from the outer frame portion for guiding an a driver blade which extends downward from the piston and a second air path formed by a clearance between the driver blade and the injecting portion, wherein the second air path, formed by the clearance, is disposed within said nose, wherein compressed air in the returning chamber is exhausted by the second air path by passing around the bumper and flowing through the clearance between the driver blade and the injecting portion, wherein the cylinder comprises:

a large diameter portion having a portion which is brought into contact with the O-ring, the portion of the large diameter portion has a diameter larger than a diameter of another portion when the piston is disposed at the upper dead center, and a small diameter portion formed downward from the large diameter portion, wherein an outer diameter of the O-ring is constituted such that a first clearance between the O-ring and the large diameter portion is larger than 0 mm and equal to or smaller than 1.2 mm, and an inner diameter of the small diameter portion is smaller than the outer diameter of the O-ring, wherein a second clearance is provided between an inner periphery of the O-ring and an outer periphery of the groove even when the piston is disposed at any position from the upper dead center to the lower dead center, and wherein even when the piston is disposed at any position between the large diameter portion and the small diameter portion, compressed air from the returning chamber is brought into the second clearance to apply a force to the O-ring, thereby bringing the O-ring into contact with the inner periphery of the cylinder to seal the piston to the inner periphery of the cylinder.

11. A fastener driving tool according to claim 10, wherein compressed air in the returning chamber is exhausted from a second air path formed in the outer frame by passing around the bumper, thereby cooling the bumper.

12. A fastener driving tool according to claim 10, wherein the force applied to the O-ring is set not to exceed a predetermined level to keep friction loss between the O-ring and the cylinder below a predetermined level.

13. A fastener driving tool according to claim 10, wherein when the outer diameter of the O-ring is worn beyond a predetermined amount, the piston is not held at the upper dead center and falls toward the lower dead center, thereby indicating that the O-ring is beyond a usable limit.

14. A fastener driving tool comprising:

a housing;

a cylinder disposed in the housing and having a large diameter portion, a small diameter portion and an inclined face portion connecting between the large diameter portion and the small diameter portion;

a piston disposed in the cylinder and movable between an upper dead center and a lower dead center, the piston having a groove in a ring-like shape at outer periphery thereof, the groove having an upper surface, a lower surface and a side surface;

an O-ring disposed between the upper surface and the lower surface of the groove with a first gap and between the side surface of the groove and an inner surface of the cylinder with a second gap;

a driver blade extending downward from the piston;

a bumper disposed in the cylinder and brought in contact with the piston when the piston is at the lower dead center; and a nose disposed at a lowermost portion of the housing and having an opening to guide the driver blade and a fastener, the nose having a larger diameter opening portion and a small diameter opening portion, wherein the O-ring contacts with the upper surface of the groove and the inner surface of the large diameter portion of the cylinder when the piston is at the upper dead center so that compressed air in the cylinder is exhausted through the large diameter opening portion of the nose, and wherein even when the piston is disposed at any position between the large diameter portion and the small diameter portion, compressed air in the cylinder is brought into the second gap to apply a force to the O-ring, thereby bringing the O-ring into contact with the inner periphery of the cylinder to seal the piston to the inner periphery of the cylinder.

15. The fastener driving tool according to claim 14, wherein a lowermost of the driver blade is at the large diameter opening portion of the nose so as to provide a gap between the driver blade and an inner surface of the nose when the piston is at the upper dead center.

* * * * *